United States Patent [19]

Judd

[11] Patent Number: 4,934,937

[45] Date of Patent: Jun. 19, 1990

[54] COMBAT TRAINING SYSTEM AND APPARATUS

[76] Inventor: Tommy Judd, 1815 Academy St., Apt. 226B, Watertown, N.Y. 13601

[21] Appl. No.: 284,183

[22] Filed: Dec. 14, 1988

[51] Int. Cl.[5] ..... F41G 3/26

[52] U.S. Cl. ..... 434/21; 434/17; 273/1 E; 273/311; 273/371

[58] Field of Search ..... 434/17, 18, 19, 20, 434/21, 22, 23, 24, 356; 273/1 E, 310, 311, 312, 316, 371, 372, 323

[56] References Cited

U.S. PATENT DOCUMENTS

| | | | |
|---|---|---|---|
| 2,404,653 | 7/1946 | Plebanek | 273/311 |
| 3,104,478 | 9/1963 | Strauss et al. | 434/22 |
| 3,238,642 | 3/1966 | Ohlund | 434/16 |
| 3,294,401 | 12/1966 | Nicholas et al. | 273/311 |
| 3,914,879 | 10/1975 | Taylor, III et al. | 434/19 |
| 4,340,370 | 7/1982 | Marshall et al. | 434/22 |
| 4,487,583 | 12/1984 | Brucker et al. | 434/22 |
| 4,561,849 | 12/1985 | Eichweber | 273/311 |
| 4,586,715 | 5/1986 | Scolari et al. | 434/21 |
| 4,786,058 | 11/1988 | Baughman | 273/371 |

OTHER PUBLICATIONS

"Lasers to Keep GIs on Target" by Curran et al., Electronics, Jun. 23, 1977, pp. 96–97.

*Primary Examiner*—Richard J. Apley
*Assistant Examiner*—Joe H. Cheng
*Attorney, Agent, or Firm*—Thomas & Kennedy

[57] ABSTRACT

A system for training soldiers in the use of firearms under simulated combat conditions has an enemy representative target and a simulating enemy firearm fire generator to arrest simulated enemy fire in response to the target being shot with a round of live ammunition.

17 Claims, 3 Drawing Sheets

COMBAT TRAINING SYSTEM AND APPARATUS

TECHNICAL FIELD

This invention relates to systems and apparatuses for use in training soldiers, police and security personnel in the use of firearms under simulated combat conditions.

BACKGROUND OF THE INVENTION

In training combatants such as police officers and soldiers in the use of small arms, it is often desirable to employ methods and equipment to simulate conditions that the combatants might experience in actual combat. When soldiers fire their weapons at an enemy, the enemy usually also has weapons and can return fire. Military combat entails noise, smoke and muzzle flash which impedes combat effectiveness. Thus, firearm training for combat involves more than mere training in static marksmanship since the trainees are in engagement with elusive targets that themselves normally attempt to shoot the trainees.

Efforts have heretofore been made to develop training procedures and equipment to improve survivability of combatants in armed conflict. The most basic method is traditional target practice where a static target is fired upon by trainees with live ammunition. While this is useful in familiarizing trainees with their weapon and in developing good marksmanship, it lacks the dynamics and realism of actual battle. In other words, it only trains the soldier for offensive action against static targets. Actual combat, of course, simultaneously involves both offensive and defensive action since the target is also firing and moving about.

Efforts have been made to improve the realism of combat training through the use of lasers to simulate weapon fire by both trainees and the enemy. Typical of such systems is that described in U.S. Pat. No. 4,487,583. Here combatants are equipped with garments that bear devices for detecting strikes by laser beams. This arrangement allows combatants to shoot at one another so as to hone both offensive and defensive skills. However, this type of system still lacks elements of realism provided by the use of real firearms that involves recoil, noise and heat, and the psychology attendant to the use of real weapons.

It thus is seen that a need has long existed for combat training systems and apparatuses that provide more realistic simulation in the training for combat. It is to the provision of such, therefore, that the present invention is directed.

SUMMARY OF THE INVENTION

In one form of the invention, a system for training soldiers in the use of firearms under simulated combat conditions comprises an enemy representative target configured for change between an apparent non-threatening posture and an apparent threatening posture and means for changing the target between those postures in response to the target being shot by a trainee with a round of live ammunition. The system also comprises means for simulating firearm fire by the target which includes means for projecting a light beam from the proximity of the target toward an area in which a trainee soldier may be located. The system also has means for arresting the simulated firearm fire in response to the target being shot with a round of live ammunition. Means are also included for detecting the passage of a light beam in close proximity to or onto the trainee and for generating a signal in response thereto that may be detected by the trainee.

In another form of the invention, a method of training a soldier in the use of firearms under simulated combat conditions involves having the soldier shoot bullets at a target of a type that responds to bullet impact by a change in target posture while the target shoots at the soldier with simulated firearm. The target terminates or suspends simulated firearm fire in response to a bullet impacting the target.

In another form, a method of training a soldier in the use of firearms under simulated combat conditions comprising the steps of directing a light beam from the proximity of an enemy target in the general direction of the soldier as simulated enemy fire, firing live ammunition rounds by the soldier at the target, and halting or suspending the simulated fire in response to the target being struck by a round of live ammunition.

In yet another form of the invention, simulated firearm fire apparatus is provided for use with a target of the type that responds to the impact of a live round of ammunition by altering its configuration from an apparent threatening to an apparent non-threatening posture. The apparatus comprises means for detecting changes in the posture of the target, means for emitting light beams simulating firearm fire by the target, and means for controlling the light beam emitting means in response to detections of target posture changes made by the detecting means.

DETAILED DESCRIPTION OF THE DRAWINGS

Figure 1:
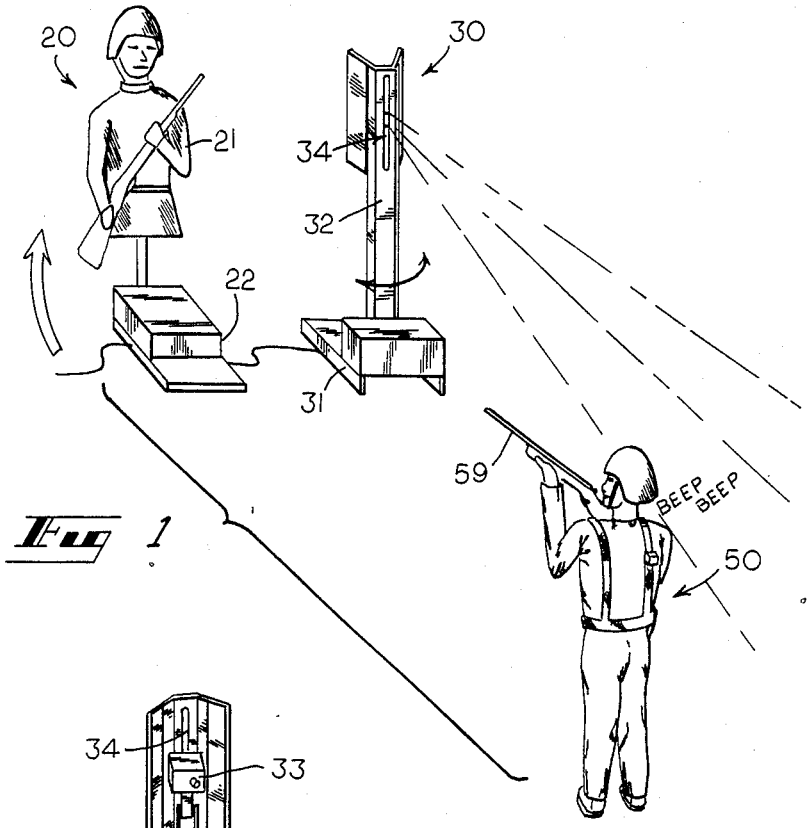
FIG. 1 is a perspective view of a system that includes simulated firearm fire apparatus which embody principles of the invention.

Referring now in more detail to the drawings, a system for training soldiers in the use of firearms under simulated combat conditions which generally is comprised of an enemy target 20, an enemy fire simulator 30 and a simulated fire detector and alarm system 50. The target 20 here is a conventional "pop-up" target commonly known as an army target holding mechanism M31A1. It has a target torso or mannequin 21 pivotably mounted to the base 22 for movement between a generally horizontal or lower position and a generally vertical or upright position.

Figure 6:
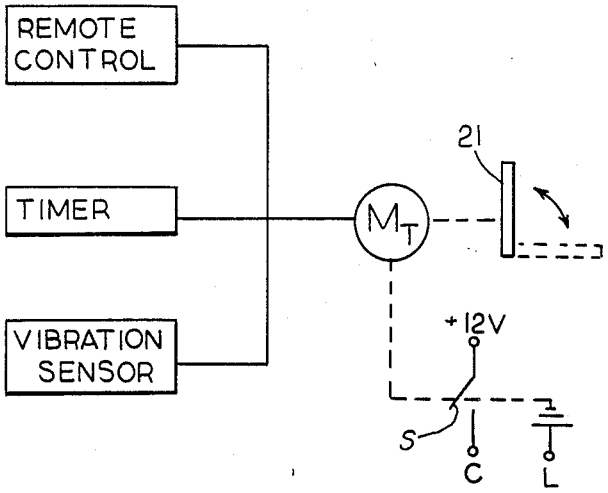
FIG. 6 is a block diagram of electrical components of the target element of the system.

The M31A1 pop-up target is electrically operated as generally shown in FIG. 6 wherein an electric motor $M_T$ is shown coupled with the soldier mannequin so as to raise and lower it upon motor actuations. The mannequin itself is made of a material to arrest and absorb bullets. It bears a vibration sensor that responds to bullet impacts by generating and transmitting a control signal that causes the motor to lower the mannequin.

The mannequin is later returned by the motor to its raised position by either remote or timer control.

When the motor positions the mannequin in its raised position, as shown in solid lines here, it operates a switch S which couples the target terminal C to a source of 12 volts. The motor is also coupled with the control circuit such that the mannequin vibration resulting from bullet impacts generate a signal that causes the motor to lower the target. Conversely, the motor is controlled to raise the target by either a remote controller or by an internal timer. Again, this "pop-up" target 20 is conventional and commercially available.

Figure 2:
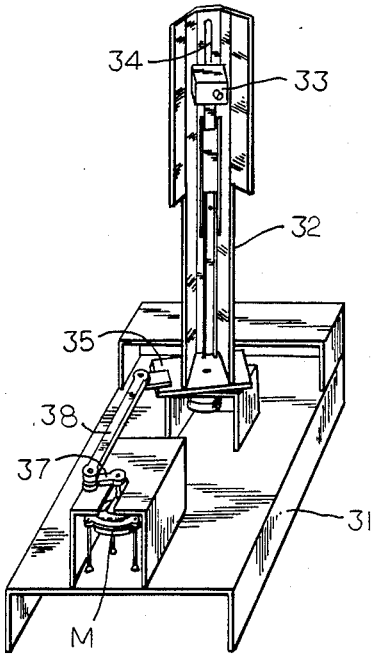
FIG. 2 is a perspective view of simulated firearm fire apparatus shown in FIG. 1 as seen from the opposite side.

The enemy fire simulator 30 has a base 31 upon which a generally U-shaped channel or post 32 is uprightly supported. A laser 33, as shown in FIG. 2, is mounted within the channel, i.e., on its rear side, so that its beam may be emitted to the front of the channel through a slot 34. The bottom of the channel is rigidly mounted atop a pivot plate 35 for pivotable movement about an upright axis of channel rotation. This plate is coupled with an electric motor M by means of link 37 and 38.

Figure 5:
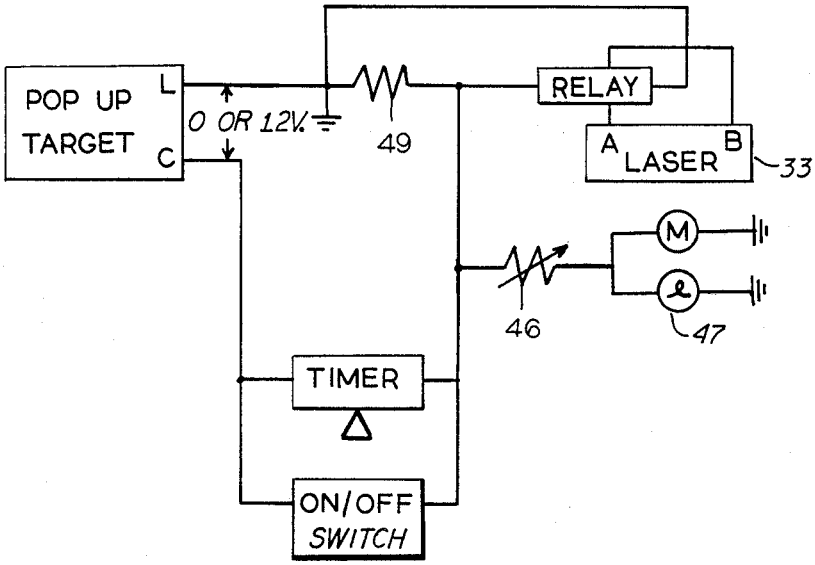
FIG. 5 is a schematic diagram of the electrical circuit of the system.

As shown in FIG. 5 the motor M of the fire simulator 30 is in an electrical circuit that is coupled across the terminals L and C of the M31A1 target holding mechanism. As previously stated, the terminal L is always grounded while the terminal C is at a potential of 12 volts DC when the target mannequin is in its raised position and at ground potential when it is in its lowered position. The motor M as well an incandescent lamp 47 are connected in the circuit through a potentiometer 46. If desired, a noise generator may also be so connected. The potentiometer itself is connected to the L terminal through a current resist limiting resistor 49 and to the C terminal through an off-on switch. A timer is connected across the on-off switch. The laser 33 is incorporated into this control circuit for operation in response to the operation of a relay that is connected across the resistor 49.

Figure 3:
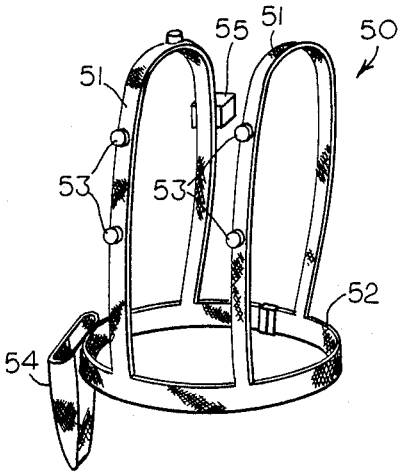
FIG. 3 is an enlarged perspective view of the system component shown being worn by a trainee in FIG. 1.

With continued reference to the drawing the system is also seen to comprise a simulated fire detector and alarm apparatus 50 which is configured to be worn by a trainee soldier. As shown in FIG. 3, this apparatus comprises a harness that has a pair of shoulder straps 51 secured to a waist band or belt 52 to which a gun holster 54 depends. Four laser sensors 53 are mounted to a front portion of the shoulder straps. These are coupled by electrical conductors to an audible alarm 55. This too is conventional and commercially available. It functions such that the sensors sense the passage of a laser beam in close proximity thereto as well as directly onto them. In response to this they generate electrical signals, indicative of close proximity or actual direct contact, which cause the sound generator to generate correspondent alarms. Power is provided by an unshown battery mounted to the harness.

Figure 4:
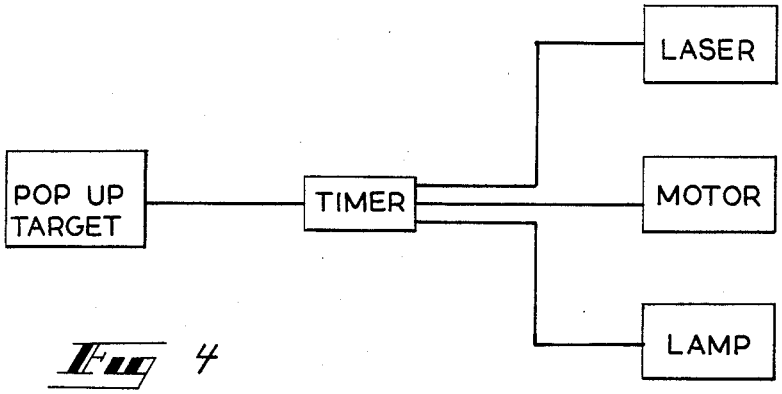
FIG. 4 is a block diagram of electrical elements of the system.

In use a trainee dons the harness and prepares for training combat with a firearm such as with a rifle 59. Upon seeing the target 20 rise to its upright, apparently threatening position the trainee attempts to shoot the target. Simultaneously with the raising of the target the laser 33 begins to flash in response to timer operations and to scan the area in which the trainee is located. This is done by motor actuations which pivot the channel to which the laser is mounted. With timer control both the scan and laser are operated intermittently, as shown in FIG. 4. Alternatively, the timer may be inactivated by turning the on/off switch on. Scan speed may be altered by changing the setting of the potentiometer 46.

In the event a beam of light from the laser comes into close proximity to the trainee it is sensed by the sensors 53 and the sound generator 55 begins to emit a beep beep sound, as shown in FIG. 1. If a direct contact is made with the laser beam upon one or more of the sensors the light and sound become steady indicating to the trainee that he has been shot. Conversely, should a bullet from the trainee's rifle 59 strike the target torso 21 this hit is sensed by the pop-up target vibration sensor which serves to actuate the motor $M_T$ which lowers the target from its threatening position to a reclined, non-threatened position. Simultaneously with this action voltage across the target terminals L and C goes to zero whereupon the relay de-energizes the laser and motor. Later the pop-up target may be raised again in response to its own timer having timed the expiration of a preselected period of time or upon remote command. When this occurs the torso 21 is raised by the motor $M_T$ back to its raised position whereupon voltage is again placed across the relay to operate the laser and the motor M. Once again the laser begins to emit flashes of light in a scanning pattern.

To add additional realism to the combat situation the target or the simulated fire accessory may also generate visible light simulated enemy fire flash and emit sounds simulating gun fire. If desired smoke may also be generated.

Though the target fire simulator 30 has been shown in the preferred embodiment to be electrically coupled in the pop-up target, a mechanical coupling arrangement may instead be made wherein movements of the pop-up target mechanically trigger a simulated fire simulator switch. Also, the pop-up target may be substituted with another type of target which changes posture from a threatening to a non-threatening position in a different manner as, for example, from moving laterally between positions beside and behind cover, or by rotating between a very thin profile configuration, as observed from the field in which the trainee is located, to a full face position. Many other modifications, additions and deletions other than those just suggested may, of course, be made without departure from the spirit and scope of the invention as set forth in the following claims.

What is claimed is:

1. A system for training soldiers in the use of firearms under simulated combat conditions comprising, in combination:

an enemy representative target configured for change between an apparent non-threatening posture and an apparent threatening posture;

means for changing said target from said threatening posture to said non-threatening posture in response to said target being shot with a round of live ammunition;

means for simulating firearm fire by said target which includes means for projecting a light beam from the proximity of said target toward an area in which a trainee soldier may be located;

means for arresting said simulated firearm fire in response to said target being shot with said round of live ammunition; and means for detecting the passage of said light beam in close proximity to or onto the trainee soldier and for generating a signal in response thereto detectable by said trainee soldier.

2. The training system of claim 1 wherein said target changing means includes means for moving said target between an upright apparently threatening position and posture and a lowered apparently non-threatening position and posture.

3. The training system of claim 1 wherein said target changing means includes means for changing said target from said non-threatening posture in response to the expiration of a selected time period to said threatening posture.

4. The training system of claim 1 wherein said firearm fire simulating means includes means for scanning said light beam over said area.

5. The training system of claim 1 wherein said simulated firearm fire arresting means includes electric circuit means coupling said light beam projecting means with terminals of said target across which voltage varies with respect to the posture of said target.

6. A method of training a soldier in the use of firearms under simulated combat conditions wherein the soldier shoots bullets at a target of a type that responds to bullet impact by a change in target posture, the target shoots at the soldier with simulated firearm, and the target terminates or suspends the simulated firearm fire in response to a bullet impacting the target.

7. The training method of claim 6 wherein the passage of the simulated firearm fire closely adjacent to or onto the soldier is detectable by sensors worn by the soldier.

8. The training method of claim 7 wherein audible signals are emitted in response to the sensors detecting the simulated firearm fire.

9. A method of training a soldier in the use of firearms under simulated combat conditions comprising the steps of:

directing a light beam from the proximity of an enemy target in the general direction of the soldier as simulated enemy fire;

firing of live ammunition rounds by the soldier at the target; and halting or suspending the simulated fire in response to the target being struck by a round of live ammunition.

10. A method as claimed in claim 9 further including the step of sensing the proximity of the light beam simulated enemy fire relative to the soldier, and communicating to the soldier that fire from the enemy target simulated by the light beam has passed in close proximity or has struck the soldier.

11. A method as claimed in claim 9 further including the steps of changing the target to an apparent threatening posture prior to commencing the simulated fire and changing said target to an apparent non-threatening posture in response to said target being struck by said round of live ammunition.

12. Simulated firearm fire apparatus for use with a target of the type that responds to the impact of a live round of ammunition by altering its configuration from an apparent threatening to an apparent non-threatening posture, and with the apparatus comprising means for detecting changes in the posture of the target, means for emitting light beams simulating firearm fire by the target, and means for controlling said light beam emitting means in response to detections of target posture changes made by said detecting means.

13. The apparatus of claim 12 wherein said light emitting means for simulating enemy fire comprises a laser and means for changing the direction of the beam emitted by said laser in a field scanning mode.

14. The apparatus of claim 12 wherein said light beam emitting control means comprises electrical circuit means adapted to be coupled with electrical terminals of the target across which voltage varies in response to alterations in target configuration.

15. The apparatus of claim 14 wherein said circuit means comprises a relay operatively coupled with said laser.

16. The apparatus of claim 15 wherein said circuit means further comprises timer means for cyclically operating said relay.

17. The apparatus of claim 13 wherein said beam direction changing means comprises electric circuit means adapted to be coupled with electrical terminals of the target across which voltage varies in response to alterations in target configuration, and said electric circuit means includes an electric motor having a drive shaft linked with said laser such that movements of said drive shaft reorient said laser.

* * * * *